US009810215B2

(12) United States Patent
Ishii et al.

(10) Patent No.: US 9,810,215 B2
(45) Date of Patent: Nov. 7, 2017

(54) INTERNAL GEAR PUMP

(71) Applicant: NTN CORPORATION, Osaka (JP)

(72) Inventors: Takuya Ishii, Mie (JP); Masato Shimoda, Mie (JP); Hajime Asada, Mie (JP); Kei Hattori, Mie (JP)

(73) Assignee: NTN CORPORATION, Osaka (JP)

( * ) Notice: Subject to any disclaimer, the term of this patent is extended or adjusted under 35 U.S.C. 154(b) by 42 days.

(21) Appl. No.: 14/420,351

(22) PCT Filed: Jul. 26, 2013

(86) PCT No.: PCT/JP2013/070288

§ 371 (c)(1),
(2) Date: Feb. 6, 2015

(87) PCT Pub. No.: WO2014/024701

PCT Pub. Date: Feb. 13, 2014

(65) Prior Publication Data

US 2015/0204325 A1 Jul. 23, 2015

(30) Foreign Application Priority Data

Aug. 8, 2012 (JP) ..... 2012-175875
Oct. 31, 2012 (JP) ..... 2012-240171

(51) Int. Cl.
*F04C 2/00* (2006.01)
*F04C 2/08* (2006.01)
(Continued)

(52) U.S. Cl.
CPC ..... *F04C 2/14* (2013.01); *F01C 21/10* (2013.01); *F04C 2/086* (2013.01); *F04C 2/102* (2013.01);
(Continued)

(58) Field of Classification Search
CPC ..... F01C 21/10; F04C 15/06; F04C 2/086; F04C 2/102; F04C 2/14; F04C 11/005;
(Continued)

(56) References Cited

U.S. PATENT DOCUMENTS 3,318,253 A * 5/1967 Campolong ..... F04D 13/0613 165/104.31
3,788,784 A * 1/1974 Zimmern ..... F01C 3/025 418/152
(Continued)

FOREIGN PATENT DOCUMENTS

EP 0907023 A1 4/1999
JP 57-121485 U 7/1982
(Continued)

OTHER PUBLICATIONS

Machine Translation JP 2010-0150964 Done Apr. 6, 2016.*
(Continued)

*Primary Examiner* — Mark Laurenzi
*Assistant Examiner* — Dapinder Singh
(74) *Attorney, Agent, or Firm* — Hedman & Costigan, P.C.; James V. Costigan; Kathleen A. Costigan

(57) ABSTRACT

Provided is an internal gear pump requiring fewer machining steps, allowing inexpensive manufacture, and offering high safety from the standpoint of function. The internal gear pump 1 comprises: a trochoid 4 in which an inner rotor 3 having a plurality of outer teeth is eccentrically and rotatably accommodated in an outer rotor 2 having a plurality of inner teeth, the outer teeth meshing with the inner teeth, and in which a suction-side chamber for suctioning liquid and a discharge-side chamber for discharging liquid that has been suctioned into the suction-side chamber are formed in between the inner teeth and outer teeth; a casing 5 in which is formed a recess 5*a* for accommodating the
(Continued)

trochoid 4; and a cover 6 for closing off the recess 5*a* of the casing 5. At least some of the casing 5 is a body injection-molded from a resin composition. The invention also comprises a groove 5*d* in a portion of the recess 5*a* of the casing 5 in which the outer periphery is sealed, with a sealing ring 13 installed therein, and bushings 7 made from sintered metal that are provided integrally during injection molding in bolt fixing hole portions.

7 Claims, 7 Drawing Sheets

(51) Int. Cl.

| | |
|---|---|
| ***F04C 15/06*** | (2006.01) |
| ***F04C 2/14*** | (2006.01) |
| ***F01C 21/10*** | (2006.01) |
| ***F04C 2/10*** | (2006.01) |
| *F04C 11/00* | (2006.01) |

(52) U.S. Cl.
CPC ..... *F04C 15/06* (2013.01); *F04C 11/005* (2013.01); *F04C 2210/14* (2013.01); *F04C 2230/21* (2013.01); *F04C 2230/22* (2013.01); *F04C 2230/231* (2013.01); *F04C 2240/51* (2013.01); *F05C 2253/20* (2013.01)

(58) Field of Classification Search
CPC ..... F04C 2210/14; F04C 2230/21; F04C 2230/22; F04C 2230/231; F04C 2240/51; F04C 2253/20
USPC ..... 418/1, 99, 195, 204, 218
See application file for complete search history.

(56) References Cited

U.S. PATENT DOCUMENTS

| | | | | |
|---|---|---|---|---|
| 6,494,698 | B2 * | 12/2002 | Arnold | F01C 3/085 418/150 |
| 7,318,712 | B2 * | 1/2008 | Arnold | F01C 3/085 123/221 |
| 7,699,592 | B2 * | 4/2010 | Arnold | F04C 3/085 418/195 |

FOREIGN PATENT DOCUMENTS

| | | | |
|---|---|---|---|
| JP | 05-47457 | U | 6/1993 |
| JP | 07-208348 | A | 8/1995 |
| JP | 10-196809 | A | 7/1998 |
| JP | 2003-129966 | A | 5/2003 |
| JP | 2005-105995 | A | 4/2005 |
| JP | 2005-325784 | A | 11/2005 |
| JP | 2006-316674 | A | 11/2006 |
| JP | 2007-002690 | A | 1/2007 |
| JP | 2007-263019 | A | 10/2007 |
| JP | 2010-150964 | A | 7/2010 |

OTHER PUBLICATIONS

Machine Translation JPH 05-47457 Done Apr. 6, 2016.*
International Search Report in corresponding application dated Oct. 29, 2013.
Supplementary European Search Report dated Apr. 20, 2016.

* cited by examiner (a)

(b)

INTERNAL GEAR PUMP

TECHNICAL FIELD

The present invention relates to an internal gear pump (trochoid pump) for pumping liquids, e.g., oil, water, and chemicals.

BACKGROUND ART

In an internal gear pump (trochoid pump), an outer rotor and an inner rotor having a trochoid tooth profile are hermetically sealed in a casing. The inner rotor and outer rotor, which is fixed to a drive shaft, rotate along with the rotation of the drive shaft and act to suction and discharge liquids. Known examples of this type of pump are described, e.g., in patent documents 1 and 2.

An example of a conventional internal gear pump is shown in FIGS. 6 and 7. FIG. 6 is a perspective view of the assembly of a conventional internal gear pump. FIG. 7(*a*) is a sectional view of the internal gear pump of FIG. 6, and FIG. 7(*b*) is a sectional view of an internal gear pump having a different configuration. As shown in FIG. 6, the pump 21 mainly comprises a trochoid 24 in which an inner rotor 23 having a plurality of outer teeth is accommodated inside an annular outer rotor 22 having a plurality of inner teeth. The trochoid 24 is rotatably accommodated in a circular trochoid-receiving recess 25*a* formed in a flanged cylindrical casing 25. A cover 26 for closing off the trochoid-receiving recess 25*a* is fixed on the casing 25. As shown in FIG. 7(*a*), the casing 25 and the cover 26 are securely fastened by bolts 30 on a fixing plate 28 of the device body. The mating faces of the casing 25 and the cover 26 are machined faces that are face-sealed.

The trochoid 24 is configured so that the outer teeth of the inner rotor 23 mesh with the inner teeth of the outer rotor 22 and the inner rotor 23 is rotatably accommodated inside the outer rotor 22 in an eccentric state. Suction-side and discharge-side chambers are formed in accordance with the rotating direction of the trochoid 24 between partitioning points where the rotors are in contact with each other. A drive shaft 31 (not shown in FIG. 6) that is made to rotate by a drive source such as a motor (not shown) passes through, and is fixed, in the axial center of the inner rotor 23. A bearing 32 for supporting the drive shaft 31 is press-fitted into the cover 26. When the drive shaft 31 rotates and the inner rotor 23 rotates, the outer rotor 22 rotates in turn in the same direction as a result of the outer teeth of the inner rotor meshing with the inner teeth of the outer rotor 22. The rotation of the rotors increases the volume, and suctions liquid from an inlet into the suction-side chamber, which is under negative pressure. This suction-side chamber decreases in volume as a result of rotation of the trochoid 24 and is converted to a discharge-side chamber with increased internal pressure. The suctioned liquid is then discharged to the outlet.

A liquid-suctioning nozzle 27 that extends from the casing 25 is provided as necessary on the inlet that communicates with the suction-side chamber (FIG. 7(*b*)). A metallic or plastic mesh filter 29 for removing foreign matter in the suctioned liquid is installed at a desired location in the inlet pathway leading to the suction-side chamber, including the nozzle 27. The mesh filter 29 is spot-welded or fixed by physical mean such as a C-ring. The mesh filter 29 or the liquid-suctioning nozzle 27 is installed with a rubber packing, etc., interposed to ensure sealing performance.

PRIOR ART DOCUMENTS

Patent Documents

Patent Document 1: Japanese Patent Publication No. 4215160

Patent Document 2: Japanese Patent Publication No. 4726116

SUMMARY OF THE INVENTION

Problems to be Solved by the Invention

A cast part that is formed from cast iron or aluminum that has been molded by aluminum die-casting or another method is used as the casing 25 of the internal gear pump 21. The cast part has low dimensional precision, and because use thereof would be a problem without machining, the trochoid-receiving recess 25*a* is machined to a finished internal diameter and depth. In particular, in order for the trochoid-receiving recess 25*a* to be formed eccentrically with respect to the axial center of the casing 25, for example, the machined portions other than the trochoid-receiving recess 25*a* are cut so as to be concentric with reference to the axial center of the casing 25, and the trochoid-receiving recess 25*a* is cut by eccentrically rotating the casing 25 using a jig. Such a two-step machining process causes an increase in cost.

As a countermeasure, investigations have been carried out (e.g., patent document 1) whereby the entire assembly, including the trochoid-receiving recess, is cut concentrically with respect to the axial center of the casing, and installation on the device body is then carried out with offset between the axial centers of the body and the casing. However, with the cover that closes off the trochoid-receiving recess, a problem is presented in that it is necessary to perform processing with the axial centers of the hole and outer diameter offset, so that orientation must be taken into account when the cover is attached to the body.

In addition, the cast parts, e.g., the aluminum die-cast parts, are deburred by shot blasting or another technique, which roughens the mating faces of the casing and the cover. In addition, the mating faces must be machined because the dimensional precision may be low, and liquid may leak from mating faces if they have not been machined. Moreover, metals such as die-cast aluminum have high rigidity, and must be machined because warping and planarity have a strong influence on discharge performance, even if bolts are used to achieve a tight fit to the fixing plate of the device body. Additionally, in order to prevent leaking of liquid, investigations have been carried out into sealing the outer periphery of the trochoid-receiving recess with a rubber ring, but the recess (groove) where the rubber ring is to be installed must be machined in such a case.

The casing of the internal gear pump is a cast part, as described above, and the cover is a cast part made of cast iron or the like, a metal part obtained by melting, or a metal part obtained by sintering, so that metal parts are used for both components. In addition, from the standpoint of dimensional precision, sintered metal parts are used for the outer rotor and inner rotor. The internal gear pump pumps liquids such as oil, water, or chemicals in normal operation, and these liquids have a wetting action. However, water, chemicals, etc. have a lesser wetting effect than oils, and metal-metal often occurs, resulting in abrasion. In addition, during the initial operating period after installation in a device, or when restarting after a long period of non-operation, metal-metal contact without liquid in the trochoid tends to occur. With compressors of the type used, e.g., in air conditioners, there are cases in which the compressor is restarted yearly after 6-12 months of inactivity.

When abrasive metallic particles resulting from metal-metal contact get caught in the sliding parts of, e.g., a scroll-type compressor (e.g., tip seals, scroll members, thrust bearings, or radial bearings), abrasion of the sliding members is accelerated, which can reduce durability, increase power consumption, and degrade air conditioning performance. In particular, with scroll-type compressors that have carbon dioxide gas as a refrigerant, the discharge pressure is 8 MPa and above, and as great as 10 MPa and above. Consequently, even trace amounts of metal abrasion particles can easily cause abrasion of sliding members such as tip seals and/or scroll members that are made of aluminum alloy.

The present invention was contrived to address such problems, it being an object of the invention to provide an internal gear pump that offers high safety from a functional standpoint, and enables manufacturing costs to be reduced by eliminating machining steps.

Means for Solving the Problem

The internal gear pump of the present invention is an internal gear pump that has a trochoid in which an inner rotor having a plurality of outer teeth is eccentrically and rotatably accommodated in an outer rotor having a plurality of inner teeth, the outer teeth meshing with the inner teeth, and a suction-side chamber for suctioning liquid and a discharge-side chamber for discharging liquid suctioned into the suction-side chamber are formed between the inner teeth and outer teeth; said internal gear pump being characterized by comprising a casing in which is formed a recess for accommodating the trochoid and a cover for closing off the recess of the casing, at least some of the casing being a body injection-molded from a resin composition. In addition, the invention is characterized in that the inner face of the recess of the casing comprises a body injection-molded from a resin composition, and the bottom face of the recess comprises a metal body that is integrally provided during injection molding.

The invention also is characterized in that the outer rotor, the inner rotor, and the cover are sintered metal bodies. The invention is also characterized in that mating faces of the casing and cover and the face constituting the recess of the casing are non-machined faces.

The invention also is characterized in that the injection-molded body has a groove in a portion of the recess of the casing where the outer periphery is sealed, and a sealing ring is installed in the groove.

The invention also is characterized in that the casing and the cover are securely bolted, and a sintered metal bushing is provided integrally during injection molding in a bolt fixing hole portion of the injection-molded body.

The invention also is characterized in that the casing has a flange part that serves as a cover fixing part, and a metal plate is integrally provided in the flange part during injection molding.

The invention also is characterized in that the resin composition has a thermoplastic resin as a base resin, at least some of the communication pathway leading to the suction-side chamber comprises a body injection-molded from a resin composition, and a metallic filter is securely welded in this portion.

The invention also is characterized in that the resin composition has a polyphenylene sulfide resin as a base resin and is produced by blending at least one of a glass fiber, carbon fiber, and inorganic filler therein.

The invention also is characterized in that the internal gear pump is a pump for supplying the liquid to the sliding parts of a scroll-type compressor.

Effect of the Invention

According to the internal gear pump of the present invention, at least some of the casing in which is formed the recess for receiving the trochoid constituted by the inner rotor and outer rotor is injection-molded from a resin composition, which allows costs to be brought lower than when the entire casing is made from a metal part, and increases the degree of shape freedom. Moreover, the frictional abrasion characteristics of the outer rotor and inner rotor can be improved, and generation of metal abrasion particles can be reduced. The invention also is effective during start-up when pumping water, chemicals, or other media that have a poor wetting effect, or when liquid is not present in the trochoid.

In particular, variability in discharge performance can be minimized while improving frictional abrasion characteristics because the inner face of the recess of the casing comprises a body injection-molded from a resin composition, and the bottom face of the recess comprises a metal body provided integrally during injection molding.

Because the outer rotor and inner rotor are sintered metal bodies, there are no protrusions at the surfaces thereof, and the casing, which is a resin molded body, will not be abraded thereby. In addition, liquid such as oil is retained in the surface recess of the sintered metal body, and the characteristics of frictional abrasion relative to the resin-molded casing body are dramatically improved. In addition, because the cover is a sintered metal body as well, the dimensional precision at the mating face with the casing is exceptional, even without machining.

A casing body molded from a resin has lower rigidity than when made from a metal such as die-cast aluminum; therefore, when the casing and the cover are bolted or otherwise fixed to the body, the casing body deforms to adapt to the mating face of the cover comprising a sintered metal body. For this reason, liquid leakage can be prevented, and pumping volume variability can be suppressed.

The casing has a groove in a portion where the outer periphery of the recess is to be sealed, and a sealing ring is installed in this groove, sealing the space that accommodates the trochoid which is encompassed by the recess and the cover. Therefore liquid leakage is prevented to a greater extent, and variation in pumping volume is also suppressed.

Since the casing and cover are bolted securely, and sintered metal bushings are integrally provided during injection molding in the bolt hole portions of the injection-molded body, loosening in the fastened parts due to creep deformation of the resin is prevented. In addition, arranging the bushings in the mold during injection molding and performing composite molding to produce an integrated article forces resin into the surface recess of the sintered metal, resulting in exceptional joining strength between the two members due to an anchoring effect.

The casing has a flange part that serves as the fixing part for the cover, and a metal plate is provided integrally during injection molding on the flange part, making it possible to prevent warping of the flange part.

The resin composition has a thermoplastic resin as a base resin, and at least some of the pathway communicating with the suction-side chamber comprises a body injection-molded from a resin composition, with a metallic filter securely welded in this portion (inlet). Consequently, the metallic filter for preventing infiltration by foreign matter can be inexpensively secured in place. In addition, as a result of the secure attachment achieved by welding, sealing can be ensured without an interposed sealing member such as a rubber packing, removing any concerns about infiltration of foreign matter from the joint. In addition, the inlet is formed in the shape of a nozzle, and so the casing or the cover can also function as a liquid-suctioning nozzle.

The resin composition that forms the casing has a polyphenylene sulfide (PPS) resin as a base resin, and is produced by compounding at least one material selected from glass fiber, carbon fiber, and inorganic filler therewith. Consequently, the composition has superior oil resistance and chemical resistance, and can be used even under high temperature environments in excess of 120° C., as with a compressor. Dimensional precision is also dramatically improved.

Inasmuch, the internal gear pump of the present invention is favorably used as a pump for supplying liquids to the sliding parts of scroll-type compressors used in air conditioners.

MODE FOR CARRYING OUT THE INVENTION

Figure 1:
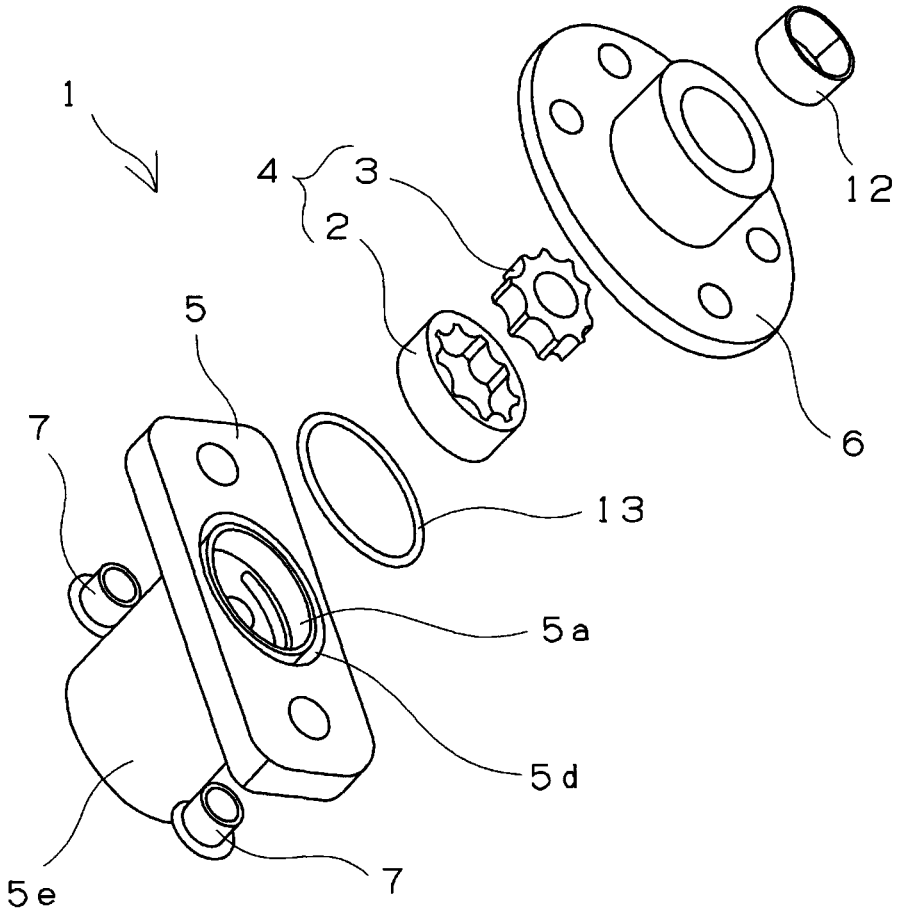
FIG. 1 is an exploded view of an example of the internal gear pump of the present invention.
Figure 2:
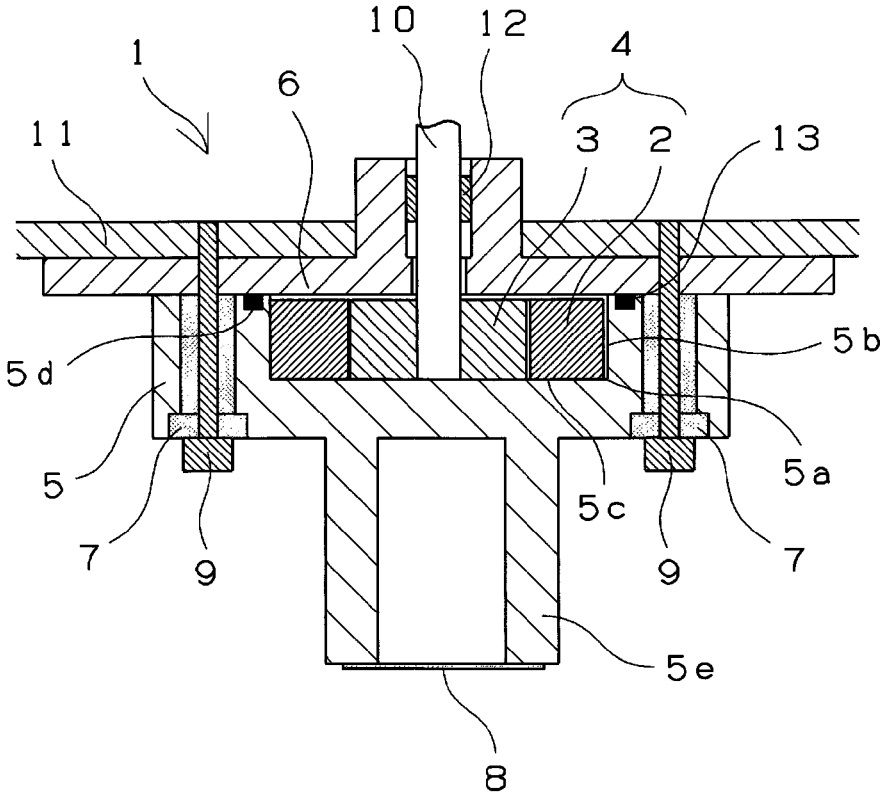
FIG. 2 is an axial sectional view of an example of the internal gear pump of the present invention.

An embodiment of the internal gear pump of the present invention is described below with reference to FIGS. 1 and 2. FIG. 1 is an exploded view of the internal gear pump. FIG. 2 is an axial sectional view of the internal gear pump. As shown in FIGS. 1 and 2, the internal gear pump 1 has a trochoid 4 in which an inner rotor 3 is accommodated in an annular outer rotor 2, a casing 5 in which is formed a circular recess (trochoid-receiving recess) 5*a* for rotatably accommodating the trochoid 4, and a cover 6 for closing off the trochoid-receiving recess 5*a* of the casing 5. The cover 6 is shaped to match the outer shape of the upper face of the casing 5 where the trochoid-receiving recess 5*a* opens. As shown in FIG. 2, the casing 5 and cover 6 are securely fastened to the fixing plate 11 of the device body by fixing bolts 9. In addition, there is provided a drive shaft 10 that is fixed coaxially at the center of rotation of the inner rotor 3. The drive shaft 10 is supported by a bearing 12 that is press-fitted into the cover 6.

The number of outer teeth of the inner rotor 3 is one less than the number of inner teeth of the outer rotor 2, and the inner rotor 3 is accommodated in an eccentric state inside the outer rotor 2, with the outer teeth in internal contact with the inner teeth and meshing therewith. A suction-side chamber and discharge-side chamber are formed in accordance with the direction of rotation of the trochoid 4 in between partitioning points where the respective rotors contact each other. A inlet that communicates with the suction-side chamber and an outlet that communicates with the discharge-side chamber are formed in a bottom face 5*c* of the trochoid-receiving recess 5*a* of the casing 5. The inlet that communicates with the suction-side chamber and the outlet that communicates with the discharge-side chamber may be formed in the casing 5, the cover 6, or the drive shaft 10.

In the internal gear pump 1, the trochoid 4 is caused to rotate by the drive shaft 10 whereby liquid is suctioned from the inlet into the suction-side chamber, which increases in volume and drops to negative pressure. This suction-side chamber then undergoes a decrease in volume and an increase in internal pressure due to rotation of the trochoid 4 and is converted to a discharge-side chamber. The suctioned liquid is then discharged to the outlet from the discharge-side chamber. The pumping action described above occurs continuously due to the rotation of the trochoid 4, and liquid is continuously pumped. In addition, as the result of a liquid sealing effect occurring from an increase in the degree to which the respective chambers are sealed by the suctioned liquid, the pressure differential arising between the respective chambers increases, and a strong pumping action is obtained.

The basic configuration and operation of the internal gear pump of the present invention was described above, but the internal gear pump of the present invention is primarily characterized in that at least some of the casing 5 is a body injection-molded from a resin composition. This results in cost benefits because the trochoid-receiving recess 5*a* can be formed by injection molding without machining. Since the outer rotor 2 and inner rotor 3 slide on the side face 5*b* and bottom face 5*c* constituting the trochoid-receiving recess 5*a*, the casing 5 is configured so that the side face 5*b* and bottom face 5*c* of the trochoid-receiving recess 5*a* are portions comprising bodies injection-molded from a resin composition, thereby improving the frictional abrasion characteristics of the outer rotor 2 and inner rotor 3 and reducing the amount of metal abrasion particles generated.

However, there is a possibility that the planarity of the bottom face 5*c* will be compromised due, inter alia, to sink marks in the resin, and that the pumping performance will vary. The incidence thereof is particularly dramatic when the liquid pathway of the inlet or outlet is formed in the bottom face 5*c* of the trochoid-receiving recess 5*a*. For this reason, it is preferable to minimize fluctuation in pumping performance by having the bottom face 5*c* of the trochoid-receiving recess 5*a* be a portion comprising an insertion-molded metal plate or the like, and the side face 5*b* be a portion comprising a body injection-molded from a resin composition to improve the frictional abrasion characteristics. The cover 6 as well as the casing 5 is a body injection-molded from a resin composition.

The base resin of the resin composition that forms the casing is a synthetic resin that can be injection molded. Examples of the base resin include thermoplastic polyimide resin, polyether ketone resin, polyether ether ketone (PEEK) resin, polyphenylene sulfide (PPS) resin, polyamide imide resin, polyamide (PA) resin, polybutylene terephthalate (PBT) resin, polyethylene terephthalate (PET) resin, polyethylene (PE) resin, polyacetal resin, and phenol resin. These resins may be used individually or may be polymer alloy mixtures of two or more types.

For the casing and cover of the internal gear pump of the present invention, it is preferable to use a base resin that undergoes minimal dimensional deformation due to absorbed water or oil and that is resistant to oil, water, chemicals, and other liquids that are to be pumped. In addition, with scroll-type compressors, it is desirable to use a resin that has a heat resistance of 150° C. or greater. Examples of resins with superior dimensional stability as well as chemical resistance and heat resistance of this type include PEEK resin and PPS resin. PPS resin is particularly desirable among these heat-resistant resins because of its superior molded body creep resistance, load resistance, and abrasion resistance, as well as its low cost.

PPS resin is a crystalline thermoplastic resin that has a polymer structure in which benzene rings are linked at the para-position by sulfur bonds. PPS resin has extremely high rigidity and superior heat resistance, dimensional stability, abrasion resistance, as well as sliding characteristics. As dictated by the molecular structure, PPS resin comes in crosslinked, semi-crosslinked, linear, and branched varieties, but linear PPS is preferred among these. Using linear PPS resin affords exceptional toughness and allows cracking to be prevented, even when the material in the flange part is not reinforced with a metal plate. Commercial PPS resins that can be used in the present invention include #160 and B-063, manufactured by Tosoh Corp., and T4AG and LR-2G, manufactured by DIC Corp.

PEEK resin is a crystalline thermoplastic resin having a polymer structure in which benzene rings are linked at the para-position by ether bonds with carbonyl groups. PEEK resin has excellent heat resistance, creep resistance, load resistance, abrasion resistance, and sliding characteristics, while also having superior molding properties. Examples of commercially marketed PEEK resins that can be used in the present invention include PEEK (e.g., 90P, 150P, 380P, 450P) manufactured by Victrex, KetaSpire (e.g., KT-820P, KT-880P) manufactured by Solvay Advanced Polymers, and VESTAKEEP (e.g., 1000G, 2000G, 3000G, 4000G) manufactured by Daicel-Degussa.

PE resins are currently marketed in a wide range from low to ultra-high molecular weight varieties. However, ultra-high-molecular-weight PE resins such as those having a weight-average molecular weight in excess of 1,000,000 cannot be used in the present invention because they cannot be injection-molded. PE having higher molecular weight has better material properties and abrasion resistance, and thus injection-moldable high-molecular-weight PE is preferred. Examples of commercially marketed PE resins that can be used in the present invention include Lubmer L5000 and L4000 manufactured by Mitsui Chemicals.

Examples of PA resins that can be used in the present invention include polyamide 6 (PA6) resin, polyamide 6-6 (PA66) resin, polyamide 6-10 (PA610) resin, polyamide 6-12 (PA612) resin, polyamide 4-6 (PA46) resin, polyamide 9-T (PA9T) resin, modified PA9T resin, polyamide 6-T (PA6T) resin, modified PA6T resin, and polymetaxylylene adipamide (polyamide MXD-6) resin. The number of carbons between amide bonds is denoted by the numerals in the polyamide resins, and T denotes a terephthalic acid residue.

There are three types of polyacetal resins that can be used in the present invention: homopolymers, copolymers, and block copolymers. In addition, examples of commercially marketed thermoplastic polyimide resins that can be used in the present invention include Aurum resins, manufactured by Mitsui Chemicals. Phenol resins are thermosetting resins that can be injection molded, and are available in novolak- and resol-type varieties, neither of which being given by way of any limitation.

It is preferable to blend blending agents in the resin composition. Examples of materials that can be blended include glass fiber, carbon fiber, whiskers, mica, talc and other such reinforcing agents that are added in order to increase strength, increase elasticity, and increase dimensional precision; minerals, calcium carbonate, glass beads and other inorganic fillers (in the form of powders or particles) that are added in order to provide abrasion resistance or eliminate anisotropy resulting from injection molding shrinkage; and graphite, PTFE resin and other solid lubricants that are added in order to provide lubricating properties.

It is preferable to use glass fiber, carbon fiber, or inorganic fillers, individually or in suitable combinations, these materials being effective in increasing strength, improving elasticity, raising dimensional precision, providing abrasion resistance, and eliminating anisotropy resulting from injection molding shrinkage. In particular, the joint use of glass fiber and inorganic fillers provides excellent economic advantages and superior frictional abrasion characteristics in oil. Moreover, the joint use of carbon fiber and inorganic fillers provides superior frictional abrasion characteristics relative to the joint use of glass fiber and inorganic fillers in non-oil applications such as those involving water or chemicals.

In the present invention, it is particularly desirable to use a resin composition that is produced by using linear PPS resin as the base resin and blending glass fiber and glass beads therewith. Such a configuration affords exceptional oil resistance and chemical resistance, and allows the material to be used in compressors or other environments involving high temperatures; i.e., those in excess of 120° C. This configuration also affords exceptional toughness, minimal warping of the flange part due to the elimination of anisotropy resulting from injection molding shrinkage, and dramatically improve dimensional precision.

The agents should be blended in ratios in which the desired characteristics can be imparted, without any adverse effect on the injection molding properties. For example, it is preferable to blend glass fiber, carbon fiber or other fiber-form reinforcing agents in the amount of 3 to 30 vol %, and to blend minerals, calcium carbonate, glass beads, or other inorganic fillers in the amount of 1 to 20 vol %, with respect to the entire resin composition.

There are no particular restrictions on the means for mixing and kneading the various raw materials described above. Molding pellets (granules) can be obtained by dry-mixing powdered raw materials in, e.g., a Henschel mixer, ball mixer, ribbon blender, Lodige mixer, or ultra-Henschel mixer, and also melt-kneading using a twin-screw extruder or other melt extruder. In addition, introduction of the filler may be carried out by side-feeding during melt-kneading using, e.g., a twin-screw extruder. The casing and/or cover are molded by injection molding using the molding pellets. A treatment such as annealing may be carried out on the molded product.

In the configuration shown in FIGS. 1 and 2, the outer rotor 2, the inner rotor 3, and the cover 6 are sintered metal bodies. In addition, the entirety of the casing 5 is a body injection-molded from a resin composition. As a result of such a configuration, when the casing 5 and the cover 6 are fixed to the body with fixing bolts, the casing 5 which is a resin molded body deforms and adapts to the mating face on the cover 6, which is a sintered metal body, thereby suppressing liquid leakage and pumping volume variability. In addition, the required dimensional precision can be ensured without machining the sinter-molded faces or injection-molded faces, resulting in an inexpensive internal gear pump in which the mating faces of the casing 5 and cover 6, and the bottom face 5*c* and side face 5*b* of the trochoid-receiving recess 5*a* can be non-machined injection-molded faces or sintered molded faces.

Although an iron-, copper/iron-, copper-, or stainless-steel-based sintered metal may be used in the outer rotor, the inner rotor, and the cover, a hard iron-based metal is preferred in order to reduce abrasion when sliding with respect to the resin composition. In addition, iron-based metals are preferred from the standpoint of cost as well. Stainless-steel-based metals having high antirust performance is desirable for use in trochoid pumps that pump, e.g., water or chemicals.

In addition, the casing has a groove in a portion of the recess where the outer periphery is sealed, and a sealing ring is preferably installed in this groove. This groove can be formed in the mold during injection molding. In the configuration shown in FIGS. 1 and 2, a groove 5*d* is provided in an outer peripheral portion of the recess 5*a* of the casing 5, and a sealing ring 13 is installed in this groove 5*d*. By installing a sealing ring 13, liquid can be prevented from leaking from the mating faces of the cover 6 and the casing 5 that are not machined faces, variability in pumping volume can be suppressed, and safety can be heightened.

There are no particular limitations regarding the material for the sealing ring; a rubber material that is well-suited to the application and use environment, such as hydrogenated nitrile rubber, fluoro-rubber, acrylic rubber, or the like, may be selected. For example, with scroll-type compressors for air conditioners, heat resistance and oil resistance at from about −30 to 120° C. are desired, for which reason hydrogenated nitrile rubber (H-NBR system) is desirably used.

Figure 7:
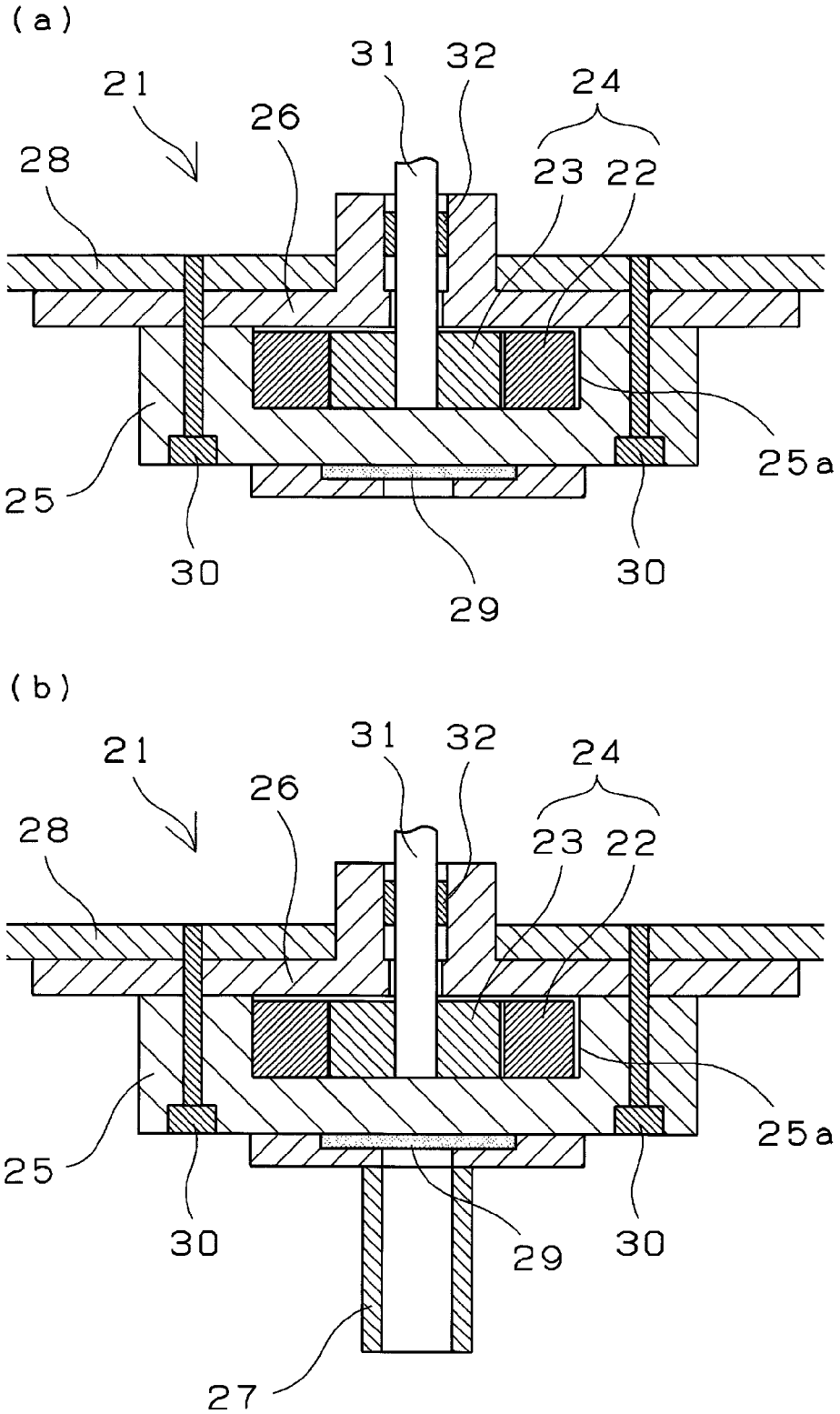
FIG. 7 is an axial sectional view of a conventional internal gear pump.

In addition, by using an injection-molded resin composition for the casing, a liquid-suctioning nozzle that is typically installed as a separate part (e.g., FIG. 7(*b*)) can be integrally formed with the casing from the resin composition. In the configuration shown in FIGS. 1 and 2, the liquid-suctioning nozzle 5*e* is formed integrally as a part of the casing 5. In addition, because this resin composition is a thermoplastic resin composition, a metallic filter 8 can be securely welded at the liquid inlet, i.e., the communication pathway entrance to the suction-side chamber. Ultrasonic welding, laser welding, or the like may be used as the welding method. The metallic filter 8 is tightly fixed to the liquid-suctioning nozzle 5*e* by welding, and sealing thus can be ensured without interposing a sealing member, preventing admixture of foreign matter from the joint.

When the casing that has been made from resin is fastened with fixing bolts to the device body, loosening of the fastened parts due to creep deformation of the resin is a concern. Using a PPS resin composition in which, e.g., a reinforcing agent of the type described above has been blended can be adopted to address creep, but the material is brittle and has poor resistance to impact in some cases. For this reason, sintered metal bushings or flanged bushings are preferably inserted into the bolt fixing hole portions, or bushings are formed integrally during injection molding by composite molding. By using sintered metal parts, resin will enter into the surface recesses of the sintered body, and joining of the resin and the sintered metal parts will occur due to an anchoring effect. In particular, the joining strength is dramatically increased by disposing the bushings in the mold during injection molding and integrating by composite molding (insert molding).

In the configuration shown in FIGS. 1 and 2, the sintered metal bushings 7 are integrated by composite molding during injection molding in the bolt fixing hole portions of the casing 5 which is a body injection-molded from a resin composition. The casing 5 and the cover 6 which is a sintered metal body are fastened and fixed to the fixing plate 11 of the device body by the fixing bolts 9 that pass through via the bushings 7.

Figure 3:
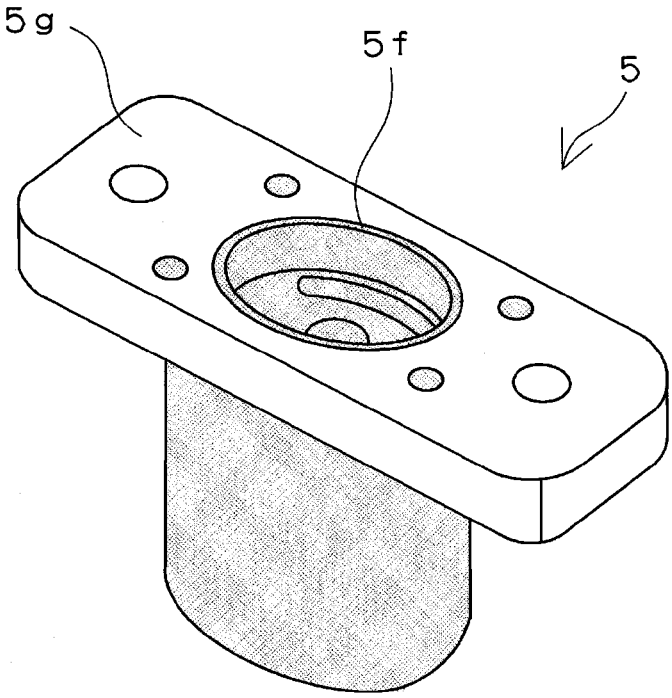
FIG. 3 shows another configuration of the casing.

When the entire body including the flange part that serves as a casing fixing portion is a body injection-molded from a resin composition, stress will concentrate at the base of the flange part if there is pronounced warping of the flange part, and cracking may occur. For this reason, it is preferable to use a structure in which the flange part is reinforced with another member. Another configuration of the casing is shown in FIG. 3. FIG. 3 is a perspective view of the casing alone. In this configuration, the body part 5*f* of the casing 5 is a body injection-molded from a resin composition as described above, and the flange part 5*g* that includes the bolt fixing hole portions is a sintered metal body. The body part 5*f* and the flange part 5*g* are preferably integrated by composite molding in the same manner as with the bushings described above. In this configuration, warping of the flange part can be prevented, and the bushings described above also are not necessary. In addition, it is also possible to obviate the sealing ring described above by face-sealing between the two sintered metal faces.

Figure 4:
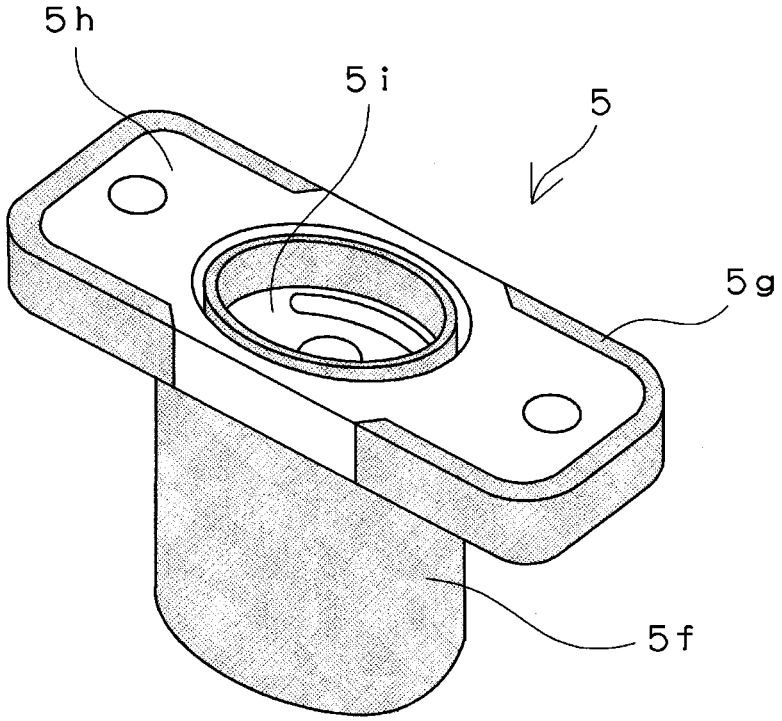
FIG. 4 shows another configuration of the casing.
Figure 4:
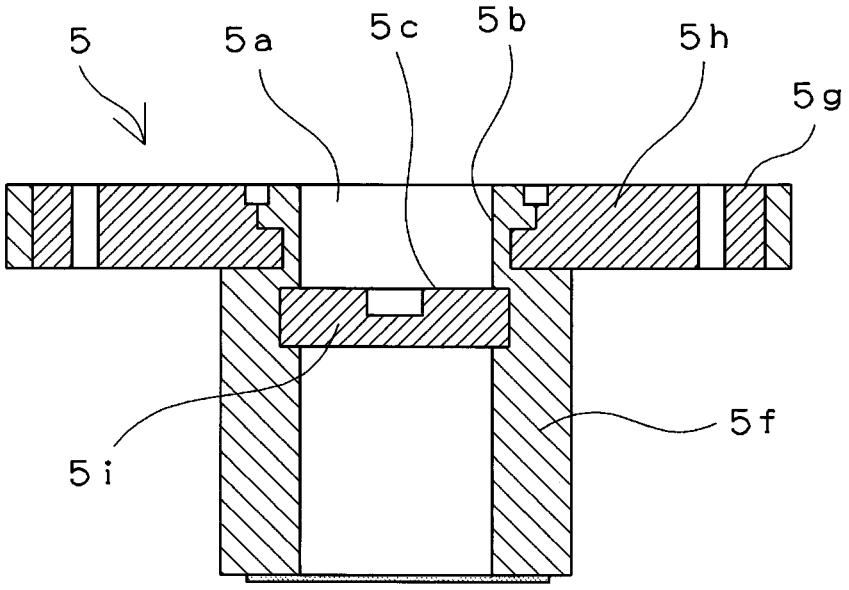

Another configuration of the casing is shown in FIG. 4. FIG. 4(*a*) is a perspective view of the casing alone, and FIG. 4(*b*) is an axial sectional view of the casing. In this configuration, the body part 5*f* of the casing 5 is a body injection-molded from a resin composition as described above, and the metal plate 5*h* that comprises sintered metal body is integrated with the flange part 5*g* by composite molding. The flange part 5*g* is provided with a shape whereby it protrudes towards the outer diameter of the cylinder at one end of the cylindrical body part 5*f* that also serves as a liquid-suctioning nozzle. As shown in the drawings, the resin portion (which is integrated with the body part 5*f*) is formed so as to partially cover the side face outer periphery of the metal plate 5*h*, making it possible to prevent shifting of the position of the metal plate 5*h*. In addition, a positioning protrusion (not shown) can be formed integrally with the cover in the resin portion that encompasses the side face outer periphery of the metal plate 5*h*, facilitating positioning of the cover and the casing. In this configuration, warping of the flange part can be prevented in the same manner as in FIG. 3, and the bushings described above are not necessary.

In the configuration of FIG. 4, a metal plate 5*i* which is a disk-shaped metal body is formed integrally at an inner part of the casing by composite molding. A liquid pathway such as an inlet or outlet is formed in the metal plate 5*i*. The plate surface other than the pathway is a smooth surface. The bottom face 5*c* of the trochoid-receiving recess 5*a* is formed by this metal plate 5*i*, and the side face 5*b* is formed as a part of the body injection-molded from a resin composition. Because the bottom face 5*c* of the trochoid-receiving recess 5*a* is formed by the metal plate 5*i*, superior planarity is obtained relative to when the bottom face is formed from resin, and it is possible to suppress variation in pumping performance. With the casing having the configuration shown in FIG. 4, the metal plates 5*h*, 5*i* are disposed in the mold during injection molding and are integrally formed by composite molding (insert molding).

A metal part obtained by sintering or metal part obtained by melting (pressed sheet metal part) can be used for the metal plate 5*i*, and the sintered metal material may be the same as the material used for, e.g., the cover described above. However, examples of metal materials obtained by melting that may be cited include iron, aluminum, aluminum alloy, copper, and copper alloy. It is preferable to use a sintered metal body because of its superior dimensional precision and capacity for strong integration with the resin portions due to anchoring effects during injection molding.

Figure 5:
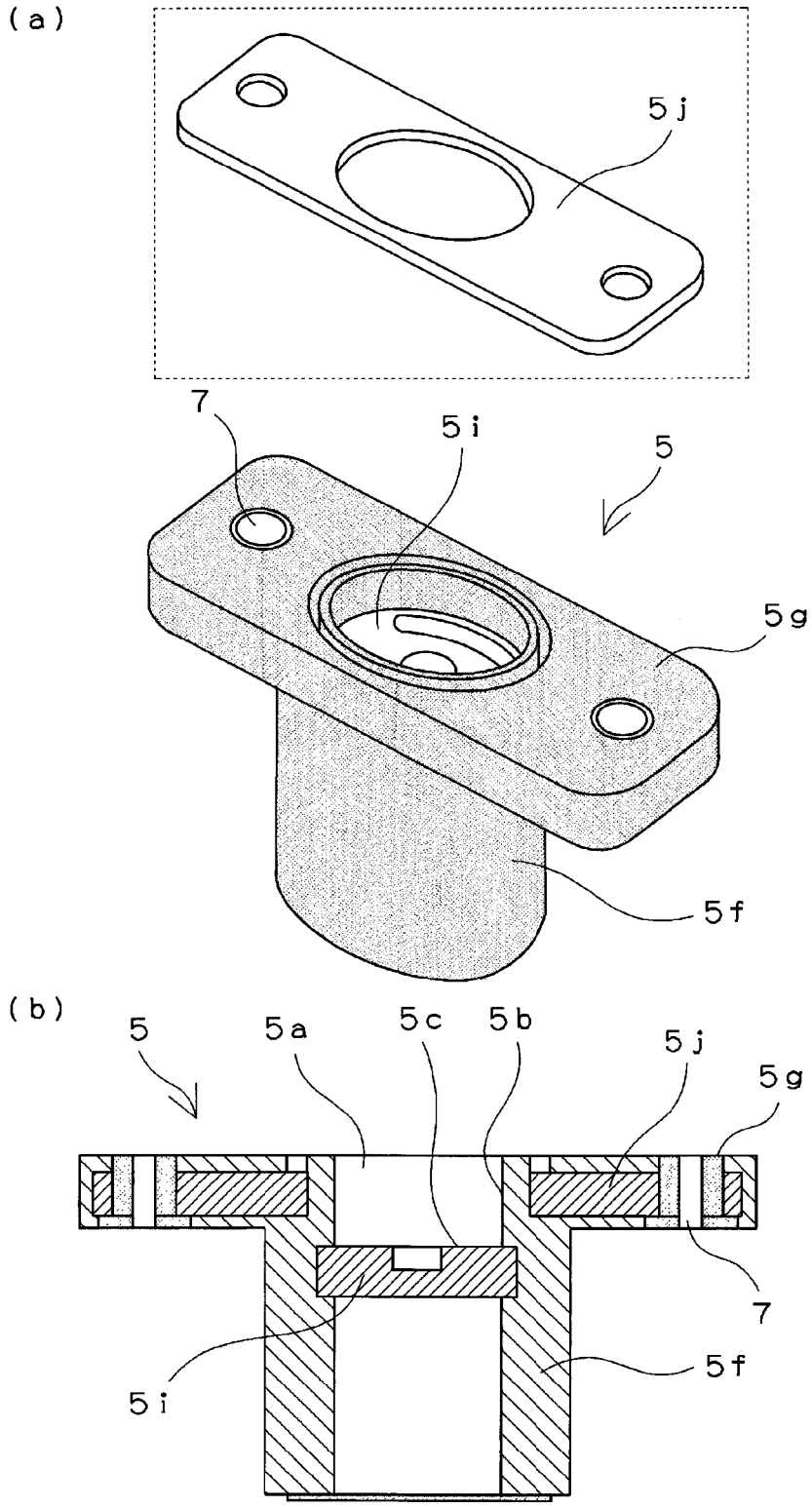
FIG. 5 shows another configuration of the casing.
Figure 6:
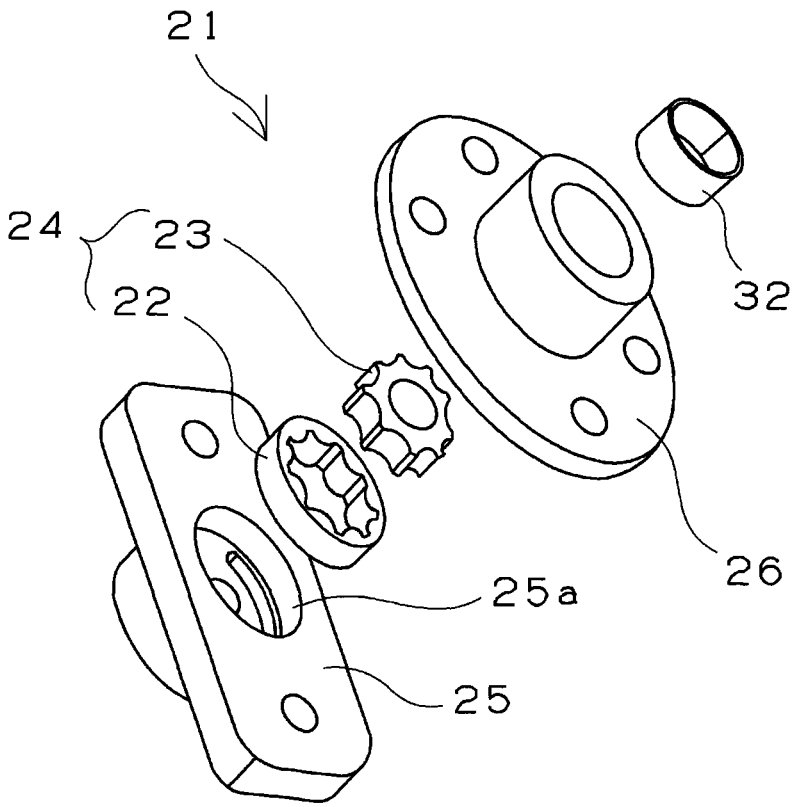
FIG. 6 is an exploded view of a conventional internal gear pump.

Another configuration of the casing is shown in FIG. 5. FIG. 5(*a*) is a perspective view of the casing alone, and FIG. 5(*b*) is an axial sectional view of the casing. In this configuration, the body 5*f* of the casing 5 is a body injection-molded from a resin composition of the type described above, and a metal plate 5*j* and the bushings 7 are formed integrally in internal parts of the flange part 5*g* by composite molding (insert molding). In addition, as in FIG. 4, a disk-shaped metal plate 5*i* is formed integrally at an interior part of the body by composite molding. With this configuration, as with FIG. 4, it is possible to prevent warping of the flange part, and it is also possible to minimize variation in pumping performance. A metal body obtained by sintering or a metal body obtained by melting may be used for the metal plate 5*j*, as with the metal plate 5*i*. In particular, even if a part punched from a metal body obtained by melting (non-machined part) or the like is used as the metal plate 5*j*, there will be no adverse effects with respect to performance with this configuration, because the metal plate 5*j* is not exposed at the cover mating face.

The casing configuration was described above, but configurations are not restricted thereby. If at least some of the casing is a body injection-molded from a resin composition, any desired combination can be used, e.g., a configuration in which this portion is also a resin portion, and the metal plate 5*i* is not provided in FIG. 4 and FIG. 5, or a configuration in which the metal plate is insert-molded at a portion of the bottom face 5*c* of the trochoid-receiving recess 5*a* in FIG. 2.

At least some of the casing of the internal gear pump of the present invention is a body injection-molded from a resin composition. Therefore, the injection-molded portion has high dimensional precision in comparison to cast parts, and e.g., a trochoid-receiving recess, an inlet, an outlet, and a groove for installing a sealing ring can be formed by injection molding without machining. In addition, machining steps can be eliminated for the mating faces of the casing and cover and the faces constituting the casing recess (bottom face and side face). For this reason, the internal gear pump of the present invention can be inexpensively manufactured.

In addition, as described above, 1) cost reduction can be achieved, and the generation of metal abrasion particles can be reduced, by having at least a portion (e.g., the recess side face) of the casing be a body injection-molded from a resin composition; 2) the invention has superior oil resistance, chemical resistance, heat resistance, and dimensional precision, because, in particular, a predetermined PPS resin composition is used as the resin; 3) loosening of the fastened parts of the casing and the cover due to resin creep deformation can be prevented, because sintered metal bushings are provided in the bolt fixing portions by composite molding; 4) infiltration of foreign matter can be prevented, because a metal mesh is securely welded to the liquid inlet that is provided in the resin molded body; 5) the generation of cracks can be prevented because a metal plate is provided by composite molding in the flange part of the casing; and 6) variability in pumping performance can be minimized because a metal plate is composite-molded in a bottom face location of the trochoid-receiving recess. A pump with a high safety factor in regard to performance is produced as a result.

INDUSTRIAL APPLICABILITY

The internal gear pump of the present invention requires fewer machining steps, enables manufacturing to be inexpensively performed, and offers high safety factor in regard to function, and accordingly can be used as an internal gear pump (trochoid pump) for pumping liquids such as oil, water, and chemicals. The invention is particularly well suited for use as a pump for supplying liquids to the sliding parts of scroll-type compressors used in electric water heaters, home air conditioners, and car air conditioners which employ, e.g., a chlorofluorocarbon substitute or carbon dioxide gas as a refrigerant.

EXPLANATION OF REFERENCE NUMERALS AND SYMBOLS

1 Internal gear pump
2 Outer rotor
3 Inner rotor
4 Trochoid
5 Casing
6 Cover
7 Sintered metal bushing
8 Metallic filter
9 Fixing bolt
10 Drive shaft
11 Device body fixing plate
12 Bearing
13 Sealing ring

The invention claimed is:

1. An internal gear pump comprising a trochoid in which an inner rotor having a plurality of outer teeth is eccentrically and rotatably accommodated in an outer rotor having a plurality of inner teeth, the outer teeth meshing with the inner teeth, and a suction-side chamber for suctioning liquid and a discharge-side chamber for discharging liquid suctioned into the suction-side chamber are formed between the inner teeth and outer teeth; said internal gear pump being characterized by comprising a casing in which is formed a recess for accommodating the trochoid and a cover for closing off the recess of the casing, at least some of the casing being a body injection-molded from a resin composition, wherein the casing and the cover are securely bolted, wherein the casing has a flange part, the flange part being part of the body injection-molded, and wherein a sintered metal bushing is provided integrally during injection molding in a bolt fixing hole portion in the flange part.

2. The internal gear pump according to claim 1 characterized in that the inner face of the recess of the casing comprises a body injection-molded from a resin composition, and the bottom face of the recess comprises a metal body that is integrally provided during injection molding.

3. The internal gear pump according to claim 1, characterized in that the outer rotor, the inner rotor are sintered metal bodies.

4. The internal gear pump according to claim 1, characterized in that the casing has a groove in a portion of the recess where the outer periphery is sealed, and a sealing ring is installed in the groove.

5. The internal gear pump according to claim 1, characterized in that the resin composition has a thermoplastic resin as a base resin, at least some of the communication pathway leading to the suction-side chamber comprises a body injection-molded from a resin composition, and a metallic filter is securely welded in this portion.

6. The internal gear pump according to claim 1, characterized in that the resin composition is a resin composition that has a polyphenylene sulfide resin as a base resin and is produced by blending at least one of a glass fiber, carbon fiber, and inorganic filler therein.

7. The internal gear pump according to claim 1, characterized in that the internal gear pump is a pump for supplying the liquid to the sliding parts of a scroll-type compressor.

* * * * *